US009441459B2

(12) United States Patent
McDaniel

(10) Patent No.: US 9,441,459 B2
(45) Date of Patent: Sep. 13, 2016

(54) WATER SHELTER OR SHED TO PROTECT A WORKER FROM HEAT, SMOKE, FIRE AND CHEMICALS

(71) Applicant: Jack Protection, LLC, Banner Elk, NC (US)

(72) Inventor: Billy Jack McDaniel, Banner Elk, NC (US)

(73) Assignee: JACK PROTECTION, LLC, Banner Elk, NC (US)

( * ) Notice: Subject to any disclaimer, the term of this patent is extended or adjusted under 35 U.S.C. 154(b) by 0 days.

(21) Appl. No.: 14/578,423

(22) Filed: Dec. 20, 2014

(65) Prior Publication Data

US 2015/0184493 A1 Jul. 2, 2015

Related U.S. Application Data

(60) Provisional application No. 61/921,199, filed on Dec. 27, 2013.

(51) Int. Cl.

| | |
|---|---|
| ***A62C 2/08*** | (2006.01) |
| ***A62C 3/06*** | (2006.01) |
| ***A62C 31/24*** | (2006.01) |
| ***E21B 35/00*** | (2006.01) |
| ***B66D 1/82*** | (2006.01) |
| ***E21B 41/00*** | (2006.01) |
| ***E04H 9/14*** | (2006.01) |

(52) U.S. Cl.
CPC ..... *E21B 41/0021* (2013.01); *E04H 9/14* (2013.01)

(58) Field of Classification Search
CPC ..... E21B 35/00; E04H 12/00; B66D 1/82; A62C 2/08; A62C 3/0264; A62C 3/06; A62C 31/24
USPC ..... 169/16, 69, 5, 48, 68
See application file for complete search history.

(56) References Cited

U.S. PATENT DOCUMENTS

| | | | | | |
|---|---|---|---|---|---|
| 1,697,376 | A * | 1/1929 | Wasson | E21B 35/00 | 166/75.11 |
| 3,685,584 | A * | 8/1972 | Gracia | A62C 37/08 | 169/22 |
| 3,698,483 | A * | 10/1972 | Martin | A62C 37/08 | 169/22 |
| 3,771,604 | A * | 11/1973 | Norman | E21B 35/00 | 166/358 |
| 3,782,474 | A * | 1/1974 | Wiseman, Jr. | E21B 35/00 | 169/11 |

(Continued)

OTHER PUBLICATIONS

Harry E. Hickey, Water Supply Systems and Evaluation Methods,: 2008, FEMA, vol. II, pp. 6, 9, 10, 122, 123.*

(Continued)

*Primary Examiner* — Arthur O Hall
*Assistant Examiner* — Joseph A Greenlund
(74) *Attorney, Agent, or Firm* — Kelly J. Hollowell; Stites & Harbison PLLC

(57) ABSTRACT

A safety device for a drilling rig derrick and methods of use thereof, wherein the safety device comprises: (i) at least one water source; (ii) a housing comprising a frame, wherein the frame has a first side and a second side; (iii) at least one pipe connected to the water source; (iv) at least two nozzles connected to the at least one pipe and to the first side of the frame, wherein the at least two nozzles are positioned to spray sheets of water that intersect one another at an intersection to define a water shed area; (v) a header attached to the at least one pipe; and (vi) a valve attached to the header, wherein the safety device is attached to and/or configured to be attached to the drilling rig derrick.

20 Claims, 8 Drawing Sheets

(56) References Cited

U.S. PATENT DOCUMENTS

| | | | | | |
|---|---|---|---|---|---|
| 3,815,682 | A * | 6/1974 | Chlasson et al. | E21B 35/00 | 166/364 |
| 4,031,961 | A * | 6/1977 | Globus | A62D 1/0064 | 169/47 |
| 4,220,208 | A * | 9/1980 | Jackson | A62C 37/09 | 169/17 |
| 4,336,843 | A | 6/1982 | Petty | | |
| 4,372,395 | A | 2/1983 | Hammett | | |
| 5,154,233 | A * | 10/1992 | Gebhardt | A62C 3/06 | 169/45 |
| 5,564,139 | A * | 10/1996 | Shorr | E03C 1/06 | 4/601 |
| 5,785,074 | A * | 7/1998 | Kieper | F16K 5/0605 | 137/312 |
| 7,350,591 | B2 * | 4/2008 | Wagner | A62C 99/0018 | 169/11 |
| 7,966,941 | B1 * | 6/2011 | Brannan | A63G 21/22 | 104/112 |
| 8,960,318 | B2 * | 2/2015 | Munroe | A62C 31/12 | 169/14 |
| 2002/0162477 | A1 * | 11/2002 | Palumbo | B61B 7/00 | 104/87 |
| 2004/0026094 | A1 | 2/2004 | Kretzschmar et al. | | |
| 2009/0078148 | A1 * | 3/2009 | Cylvick | A63G 7/00 | 104/53 |
| 2010/0186971 | A1 * | 7/2010 | Seyffert | A62C 31/22 | 169/13 |
| 2010/0264390 | A1 * | 10/2010 | Cerda | E02D 17/08 | 256/24 |
| 2010/0314138 | A1 * | 12/2010 | Weatherspoon | A62C 3/0214 | 169/16 |
| 2011/0180276 | A1 * | 7/2011 | Khalil | A62C 35/02 | 169/16 |
| 2011/0209884 | A1 * | 9/2011 | Sundholm | A62C 3/0292 | 169/46 |
| 2014/0209330 | A1 * | 7/2014 | Statter | A62C 3/0214 | 169/46 |

OTHER PUBLICATIONS

Geronimo Accident; https://www.youtube.com/watch?v=jxPR2xxOw61.

Propane Tank Fire Training; https://www.youtube.com/watch?v=trg_w-ccNig.

Geronimo Line; https://www.youtube.com/watch?v=GNPGOxUPWaQ.

Workover Rig Geronimo Rid; https://www.youtube.com/watch?v=mXK9BGMPZg.

Custom Spraying Solutions; Fire Protection—Water Wall.

Bete Performance Through Engineering; www.bete.co.uk.

* cited by examiner

WATER SHELTER OR SHED TO PROTECT A WORKER FROM HEAT, SMOKE, FIRE AND CHEMICALS

RELATED APPLICATION

This application claims priority from U.S. Provisional Application Ser. No. 61/921,199, filed Dec. 27, 2013, the entire disclosure of which is incorporated herein by this reference.

TECHNICAL FIELD

The present disclosure relates generally to safety devices for use in drilling, mining and other industrial applications where fire, explosion or chemical exposure is a safety risk for workers.

BACKGROUND

Drilling and mining for fossil fuels, such as oil, natural gas and coal are dangerous activities having a high risk of fire and explosion. According to the Centers for Disease Control, between 2003 and 2013, the U.S. oil and gas extraction industry (onshore and offshore, combined) had a collective fatality rate seven times higher than for all U.S. workers (27.1 versus 3.8 deaths per 100,000 workers). Thirteen percent of those deaths were the result of explosions and/or fires, and another thirteen percent were the result of exposure to harmful chemicals or environments.

As a rig drills a well, a pipe is extended into the earth by sections. One of the most dangerous roles for a worker on a drilling rig is the role of derrick hand. The derrick is the platform above the drill site, and it is often more than 50 feet above the floor of the drilling rig. The derrick is used as a station for the derrick hand to position and attach additional drill pipe sections as the pipe drills deeper in the well. The derrick hand controls the pipe sections as they are attached. The derrick hand also monitors the drill, drill fluids and drilling fluid (drilling mud) circulation cooling systems.

In the event that the drill enters a pressurized zone, pocket and/or area of the well, the risk of a blowout increases, and the well becomes an explosion hazard. Rigs are required by regulation to equip the wellhead with blowout preventers that can contain a blowout, an explosion and/or a fire. These systems are typically operated by a control panel on the drilling rig. Depending on the reaction time of workers in activating the blowout preventer, there can be a delay of several seconds before the blowout preventer closes off the well and extinguishes a fire or explosion. In the event of an emergency, there is no automated system to protect a derrick hand.

Temperatures above a derrick explosion can reach above 2,000 degrees Fahrenheit very quickly, so every second is critical to the survival of a derrick hand trapped above a well explosion. An added concern to the extreme heat is the smoke and chemicals created by the explosion, which billow up and surround the derrick and may suffocate the derrick hand. These time constraints are coupled with the confusion created by an explosion and the temporary shock that the explosion may induce in a derrick hand.

Current methods provided for the derrick hand to escape from the derrick are difficult to conduct, even under optimal, non-emergency conditions. For example, one commonly-accepted escape device is made by Geronimo, which is essentially a manually-controlled zip line leading off of the derrick. Unfortunately, if the device is not used precisely, the user can be killed during the escape.

Moreover, there is a need in the art for a device and/or method that will protect a derrick hand and/or aid his escape in an emergency situation. More specifically, there is a need for a device that will protect the derrick hand from fire, intense heat and/or smoke and that will provide temporary protection to a worker so that the worker can escape an explosion, fire or chemical accident. Further, what is needed is a temporary way to control, reduce and/or remove the heat around a worker during an explosion and to limit the fumes, chemicals and smoke that accumulate around the derrick hand in a fire, explosion, or chemical exposure.

BRIEF SUMMARY

This summary describes several embodiments of the presently-disclosed subject matter, and in many cases lists variations and permutations of these embodiments. This summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this summary or not. To avoid excessive repetition, this summary does not list or suggest all possible combinations of features.

In some embodiments, the present disclosure provides a derrick safety device. The derrick safety device may comprise, for example: (i) at least one water source; (ii) a housing comprising a frame, wherein the frame has a first side and a second side; (iii) at least one pipe connected to the water source; (iv) at least two nozzles connected to the at least one pipe and to the first side of the frame, wherein the at least two nozzles are positioned to spray sheets of water that intersect one another at an intersection to define a water shed area; (v) a header attached to the at least one pipe; and (vi) a valve attached to the header, wherein the safety device may be attached to a drilling rig derrick and/or to any portion thereof. Further, in some embodiments, the safety device also comprises a winch connected to the first side of the frame.

In some embodiments of the present disclosure, the intersection of the sheets of water forms and/or occurs along at least one plane. And in certain embodiments, a first sheet of water is provided in a first plane that is perpendicular to a second sheet of water that is provided in a second plane. Additionally, in some embodiments, a third sheet of water is provided in a third plane, wherein the third plane may be perpendicular to the first plane and/or the second plane. And in some embodiments, a fourth sheet of water is provided in a fourth plane that may be parallel to the third plane and/or perpendicular to any of the first, second and/or third planes.

In some embodiments, a first cone-shaped spray of water is provided, which intersects a second cone-shaped spray of water. And in certain embodiments a third cone-shaped spray of water is provided, which intersects the first and second cone-shaped sprays of water. And in some embodiments, a $4^{th}$, $5^{th}$, and/or $6^{th}$ cone-shaped spray of water is provided. In some embodiments, one or more cone-shaped sprays or sheets of water are provided as additional walls of water.

In some embodiments, additional sprays or sheets of water are provided as additional walls of water outside the water shed. In some embodiments a mix of cone-shaped sprays, sheets of water and other arrangements of water streams are used to form the water shed.

Moreover, in certain embodiments, the derrick safety device of claim 1 comprises at least two pipes, wherein at least one nozzle is attached to each pipe. And in certain embodiments, at least one of the at least two nozzles is a fog spray nozzle. Still further embodiments of the derrick safety device comprise a cable attached to the winch. And in some embodiments, the derrick safety device comprises a harness that is connected and/or removably connected to the cable.

Further, in some embodiments of the present disclosure, the water source includes at least one of a municipal water source, a pressurized water source, and/or a circulating water source. In certain embodiments, the water source is a pressurized circulating water source, such as a pressurized circulating loop water source.

In some embodiments, the valve is a two-way, spring-actuated and/or vented valve. And in certain embodiments, the valve includes a spring that can open the valve to allow water to flow through the valve. In some embodiments, water flows through the open valve, through the header, and/or to the nozzles. Meanwhile, in some embodiments, the valve comprises at least one of a temperature-actuated valve and/or a valve that is actuated in response to a predetermined change in a pressure level and/or a predetermined change in an oxygen level in the environment surrounding the valve. In some embodiments, the valve is operated by a switch or push button actuater.

Furthermore, in some embodiments, the safety device of the present disclosure comprises at least one light source. The light source may comprise a lighting fixture, and it may be attached to at least one of a first side and a second side of the frame. Indeed, in some embodiments, the safety device of the present disclosure includes at least one light source attached to the first side of the frame. And in some embodiments, the safety device includes at least one light source attached to the second side of the frame.

Additionally, in certain embodiments, the present disclosure provides a safety device kit comprising: (i) at least one pipe configured to connect to a water source; (ii) at least two nozzles configured to connect to the at least one pipe; (iii) a header configured to attach to the at least one pipe; and (iv) a valve configured to attach to the header, wherein the at least two nozzles are configurable to spray sheets or cone-shaped sprays of water that intersect one another, and further wherein the kit is a retrofit kit for a drilling rig derrick.

The kit of the present disclosure may also comprise a gate to retrofit a derrick railing in some embodiments. And in certain embodiments, the kit further comprises at least one of (i) an escape device, (ii) a winch and (iii) a harness, such as a harness is configured to be worn by and/or attached to a worker on a derrick. The escape device may also comprise an automated and/or speed regulated (i.e., geared) zip line in some embodiments.

DESCRIPTION OF EXEMPLARY EMBODIMENTS

Figure 1:
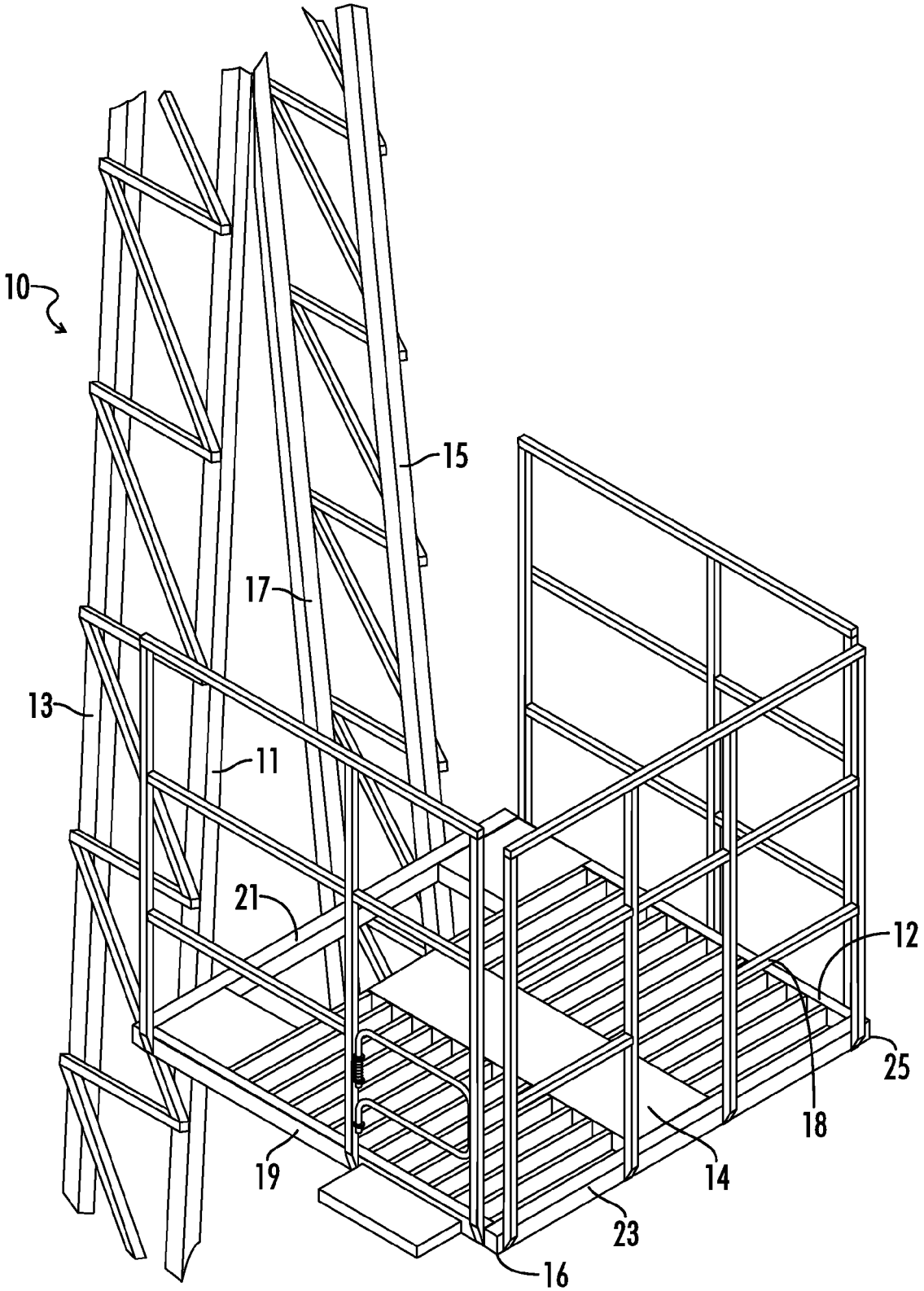
FIG. 1 is a perspective view of a derrick according to the present disclosure.

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

The presently-disclosed subject matter is illustrated by specific but non-limiting examples throughout this description. Each example is provided by way of explanation of the present disclosure and is not a limitation thereon. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

The use of any and all examples, or exemplary language (e.g., "such as") provided herein, is intended merely to better illuminate the invention(s) of the present disclosure and does not pose a limitation on the scope of the invention(s) (i.e., "such as, but not limited to,") unless otherwise claimed. No language in the specification should be construed as indicating any non-claimed element as essential to the practice of the invention(s) of the present disclosure.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

While the following terms used herein are believed to be well understood by one of ordinary skill in the art, definitions are set forth to facilitate explanation of the presently-disclosed subject matter.

Unless defined otherwise, all technical and scientific terms used herein have the same meaning as commonly understood by one of ordinary skill in the art to which the presently-disclosed subject matter belongs. Although any methods, devices, and materials similar or equivalent to those described herein can be used in the practice or testing of the presently-disclosed subject matter, representative methods, devices, and materials are now described.

Following long-standing patent law convention, the terms "a", "an", and "the" refer to "one or more" when used in this application, including the claims. Thus, for example, reference to "a hose" includes a plurality of such hoses, and so forth.

It is to be understood that the specific devices and methods illustrated in the attached drawings and described in the present disclosure are exemplary embodiments of the inventive concepts defined in the claims below. Hence, specific dimensions and other physical characteristics relating to the embodiments disclosed herein are not to be considered as limiting, unless the claims expressly state otherwise. Unless otherwise indicated, all numbers expressing quantities, properties, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, size, volume, concentration or percentage is meant to encompass variations of in some embodiments ±50%, in some embodiments ±40%, in some embodiments ±30%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

The present disclosure provides a safety device, a set of safety devices and/or a safety system for temporarily protecting a person from a hazardous environmental condition, such as a fire and/or an explosion. In certain embodiments, the device creates a protective water shelter, or water shed, wherein the device includes one or more water suppliers that emit water around a designated area or location adjacent and/or proximal to the device's housing. In some embodiments, the water suppliers of the present disclosure comprise nozzles, such as stream-spreader and/or fog nozzles.

In certain embodiments, the water suppliers of the present disclosure create a wall of water around a designated location or area. And in some embodiments, the water provided by the water suppliers forms a "water shed" that is configured to protect a worker from the heat and/or smoke associated with an explosion, fire, or other emergency condition. In certain embodiments, the provision of a water shed according to the present disclosure provides a worker with additional time and/or additional oxygen, thereby allowing the worker an opportunity to escape an explosion, fire and/or other emergency condition.

In certain embodiments, the present disclosure provides protection and/or an escape system comprising a water shed and/or additional features that will protect and/or guide a person to safety in the event of an emergency situation, such as an explosion or fire. In some embodiments, the system provides a water shed that comprises at least one water source that supplies/provides water in or to a designated area. In the event of an emergency situation, such as a fire, the water supplier is activated and will supply/provide water in the designated area. A person may then position himself in the designated area such that (s)he is protected from the fire.

In some embodiments, the safety device and/or safety system of the present disclosure comprises: (i) at least one water source; (ii) at least one pipe connected to the water source; (iii) at least one water supplier connected to the at least one pipe; (iv) a header attached to the at least one pipe; and (v) a valve attached to the header, wherein the at least one water supplier is positioned to spray water.

In some embodiments, the at least one water supplier is a nozzle. And in certain embodiments, the nozzle is a fog spray nozzle. Additionally, in at least one embodiment, the at least one water supplier is positioned to spray and/or otherwise emit and/or distribute water. And in some embodiments, the at least one water supplier provides at least one sheet, cone-shaped spray and/or other similar deluge of water.

In certain embodiments, the safety device of the present disclosure comprises at least two water suppliers, wherein the water suppliers are positioned to spray sheets of water that intersect one another. In some embodiments, the device comprises a designated area and/or a water shed wherein the sheets (or cones) of water intersect one another. And in some embodiments, the intersection of the sheets of water is along one or more planes. Indeed, in some embodiments, the safety device and/or safety system of the present disclosure is calibrated to form a water shed during operation.

In some embodiments, the intersection of the sheets of water forms and/or occurs along at least one plane and/or at least one point. And in certain embodiments, a first sheet of water is provided in a first plane that is perpendicular to a second sheet of water that is provided in a second plane. Additionally, in some embodiments, a third sheet of water is provided in a third plane, wherein the third plane may be perpendicular to the first plane and/or the second plane. And in some embodiments, a fourth sheet of water is provided in a fourth plane that may be parallel to the third plane and/or perpendicular to any of the first, second and/or third planes. In some embodiments, any of the first, second and third planes may intersect at a point and/or substantially along a line. Similarly, any of the first, second and fourth planes may intersect at a point and/or substantially along a line.

In some embodiments, a first cone-shaped spray of water is provided, which intersects a second cone-shaped spray of water along a plane. And in certain embodiments a third cone-shaped spray of water is provided, which intersects the first and second cone-shaped sprays of water at different planes. And in some embodiments, a $4^{th}$, $5^{th}$, and/or $6^{th}$ cone-shaped spray of water is provided, each of which intersects the other sprays along a different plane. In some embodiments, one or more cone-shaped sprays or sheets of water are provided as additional walls of water.

In some embodiments, additional sprays or sheets of water are provided as additional walls of water outside the water shed. In some embodiments a mix of cone-shaped sprays, sheets of water and other arrangements of water streams are used to form the water shed.

And in certain embodiments, the device comprises at least two water suppliers, which are connected either directly or indirectly to at least one of a pipe and a water source. In some embodiments, at least one of the pipe and the water source is connected to at least one other component of the safety device by a hose. For example, in certain embodiments, the water source of the present disclosure is connected to the at least one water supplier by a hose. And in a particular embodiment, a pipe of the present disclosure may comprise a hose or other similar water conduit, as known in the art.

In some embodiments, the water source may comprise a municipal water source, a circulating water source, a looped water source, a pressurized water source, a circulating loop water source, and/or any combination thereof. Further, in certain embodiments, the water source comprises a portable water source. Additionally, in some embodiments, the water source may provide, have and/or be capable of operating with sufficient pressure to operate the safety device and/or system of the present disclosure.

In some embodiments, the device of the present disclosure comprises at least two pipes, wherein at least one of said pipes is connected, either directly or indirectly, to at least one water source and at least one water supplier. Further, in certain embodiments, the device comprises at least one permanently-installed pipe that is configured to operate in one location.

In some embodiments of the present disclosure, the safety device and/or system includes a bypass system. The bypass system may comprise at least one valve, such as a two-way valve, a vented valve, a temperature-actuated valve and/or a spring-actuated valve. Moreover, in some embodiments, the valve is connected, either directly or indirectly, to the at least one water supplier. And in certain embodiments, the valve opens to allow water to flow to and/or through the at least one water supplier.

Further, in certain embodiments, the present disclosure provides a system wherein a header connects, either directly or indirectly, at least one of a pipe and a water supplier to at least one water source. Accordingly, in some embodiments, a valve of the presently-disclosed safety device may be actuated to allow water to flow through from the water source, through the header, to at least one of a pipe and a water supplier. In an embodiment, the safety device comprises a spring in the valve that can operate the valve by opening and/or closing the valve. And in some embodiments, the spring operates to open the valve, thereby allowing water to flow through the header to at least one water supplier.

The at least one valve of the present disclosure may be reset to a bypass position and/or to an open position. The safety device and/or system may also comprise means for automatically resetting one or more valves of the device and/or system to an open and/or to a bypass position. Indeed, in certain embodiments, the valve has an automatic reset feature, which resets the valve to a bypass position. Moreover, operation of the valve between an open and a bypass position may be triggered manually, electronically and/or automatically, as known in the art. Additionally, the valve may be triggered in response to a predetermined pressure and/or oxygen level. In some embodiments, a switch or button may be used to trigger the safety device.

In still further embodiments, the present disclosure provides a system and/or a method for protecting a worker from a fire or other hazardous condition. The method may comprise, for example, the steps of: (i) activating a safety device; and (ii) evaporatively cooling an area that is protected by water emitted and/or sprayed by the safety device. In some embodiments, the safety device that is useful in the method(s) of the present disclosure comprises at least one water source, at least one pipe connected to the water source, at least two water suppliers, such as nozzles, connected to the at least one pipe, at least one header attached to the at least one pipe, a valve attached to the header, and/or any combination of the aforementioned components.

One or more components of the system and/or device of the present disclosure may be controlled and/or activated in one or more ways. For example, in some embodiments, a button will be provided in a driller's house and/or in a location that can be easily accessed by the derrick hand, such that when the button is pressed the system and/or device is activated. Indeed, in some embodiments, there is an activation device and/or activation mechanism provided in easy reach of the derrick hand such that the hand can pull, push and/or otherwise manipulate the mechanism in order to discharge water in the system. Additionally, in some embodiments, the system and/or device of the present disclosure comprises a means for overriding the system at an electronic control valve. And in still other embodiments, the system and/or device of the present disclosure comprises a pull valve that the derrick hand can manipulate in order to activate the device. In at least one embodiment, the system, device and/or water shed of the present disclosure is deployed/activated when a driller pushes a button to discharge the system. Indeed, in an embodiment, an operator, such as a driller, a derrick hand or another person, such as a person on the ground, manipulates a button and/or other physical device in order to discharge the system. The discharge may be, in certain embodiments, the result of movement of an electronic control valve. In certain embodiments, once the system/device is activated, water will be continuously discharged until a person manually turns off the system.

Further, the device and/or system of the present disclosure may include one or more fusible links, wherein the one or more fusible links has one or more temperature ratings, as known in the art. In a particular embodiment, the system and/or device of the present disclosure comprises two or more fusible links, wherein at least one of the fusible links has a first temperature rating and at least one other of the fusible links has a second temperature rating that is different from the first temperature rating. In certain embodiments, the fusible links of the present disclosure have a temperature rating of greater than about 200, about 250, about 300, about 350, about 400, about 450, about 500, about 550, about 600, about 650, about 700, about 750, about 800, about 850, about 900, about 950 and/or about 1000 degrees Fahrenheit.

Meanwhile, in other embodiments, the present disclosure provides a system and/or a method for protecting a worker from a fire, comprising, for example, the steps of: (i) calibrating a safety device; (ii) supplying water to the safety device; and (iii) spraying two or more sheets of water from the safety device, wherein the two or more sheets of water form a water shed to protect an area inside the device. In certain embodiments, the safety device that is useful in said method(s) comprises at least one pipe connected to a water source, at least two water suppliers, such as fog spray nozzles, connected and/or attached to the at least one pipe, at least one header attached to the at least one pipe, and at least one valve connected and/or attached to the at least one header.

In certain embodiments, the methods of the present disclosure comprise a step of spraying sheets of water. In some embodiments, the sheets of water are sprayed on a worker located within a safety device and/or within a water shed and/or within a designated area of a water shed within the safety device. Further, in some embodiments, the sheets of water define the boundaries of the water shed. And in certain embodiments, the step of spraying sheets of water comprises spraying sheets of water that form one or more "walls" of the water shed. And in still further embodiments, the step of spraying sheets of water may include spraying sheets of water forming walls, wherein at least one wall of water provides a lower plane (i.e. a "floor") and/or wherein at least one wall of water comprises an upper plane (i.e. a "ceiling") of water within the water shed. Indeed, the safety device may comprise water suppliers that emit and/or spray water in one or more directions and/or in one or more planes.

In certain embodiments, the methods of the present disclosure comprise a step of spraying cone-shaped sprays of water. In some embodiments, the sprays are sprayed on a worker located within a safety device and/or within a water shed and/or within a designated area of a water shed within the safety device. Further, in some embodiments, the cone-shaped sprays of water define the boundaries of the water shed. And in certain embodiments, the step of spraying cone-shaped sprays of water comprises spraying water that form one or more round "walls" of the water shed. And in still further embodiments, the step of spraying walls of water may include spraying sheets of water forming walls, wherein at least one wall of water provides a lower barrier and/or wherein at least one wall of water comprises an upper barrier of water within the water shed.

Further, in certain embodiments, the methods of the present disclosure include a step of evaporatively cooling any component of the safety device and/or system itself and/or any designated area within the water shed and/or any object or person located within the water shed.

In some embodiments, the safety device and/or safety system of the present disclosure is configured to spray and/or emit water onto the at least one pipe or other item. And in some embodiments, the methods of the present disclosure include a step of spraying water onto at least one pipe or other item. In an embodiment, the spraying of water onto the at least one pipe or other item can, for example, protect the pipe or other item from a fire, an explosion, or other hazardous environmental condition.

The safety device and/or system of the present disclosure may also comprise a portable frame. The portable frame may comprise water suppliers, such as nozzles, that are configured to protect the portable frame itself and/or a worker located in close proximity thereto, such as within the frame. In certain embodiments, the boundaries and/or planes that define the water shed are located within the portable frame. And in some embodiments, the frame, such as a portable frame, comprises a first side and a second side. Further, in some embodiments, the frame comprises a first wall having at least a first side and a second side and/or a second wall having at least a first side and a second side and/or a third wall having at least a first side and a second side. In certain embodiments, at least one wall of the frame may be rectangular in shape.

In certain embodiments, the safety device and/or system of the present disclosure can direct heat, smoke, pollutants, chemicals and/or fire out of and/or away from the area inside the water shed and/or an area defined by the frame. Likewise, the methods of the present disclosure may include a step of directing and/or deflecting heat, smoke, pollutants, chemicals and/or fire out of and/or away from the area inside the water shed. And in some embodiments, said methods include a step of protecting a worker from a fire and/or other hazardous environmental condition.

Figure 5:
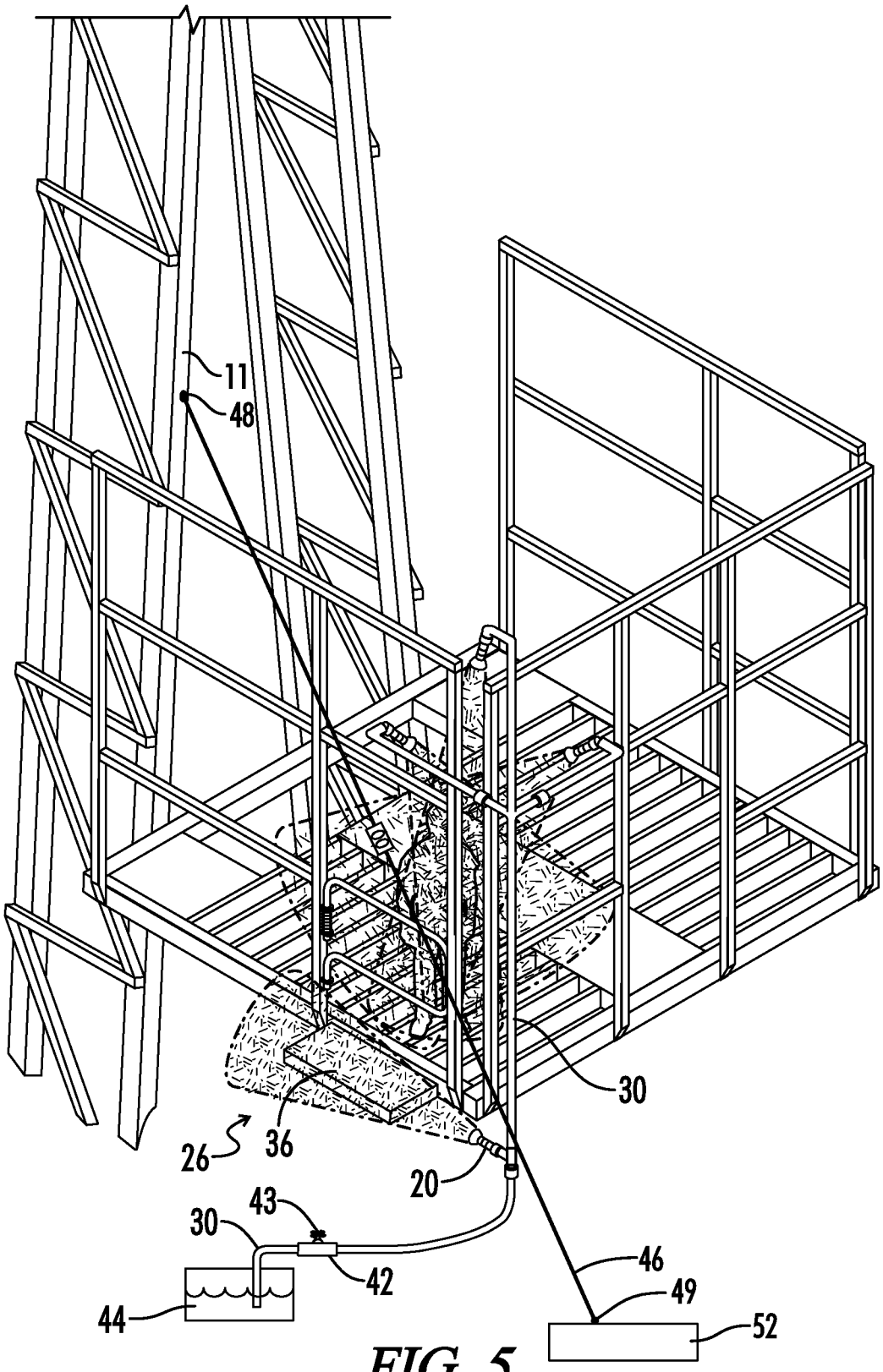
FIG. 5 is a perspective view of an embodiment of a safety device and water shed of the present disclosure.
Figure 6:
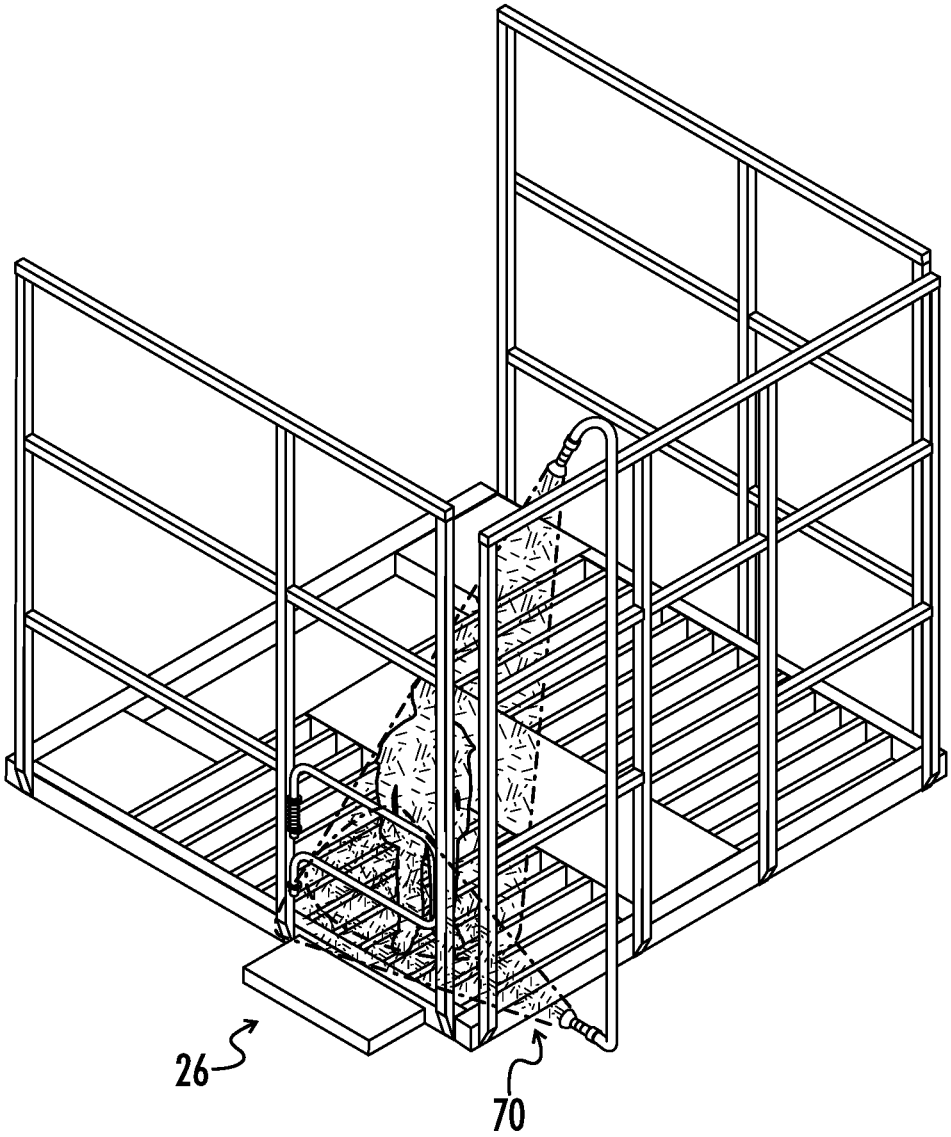
FIG. 6 is a perspective view of an embodiment of a safety device and water shed of the present disclosure.

Further, in some embodiments, the water shed comprises the shape of a shield, as shown in FIG. 6. And in other embodiments, the water shed comprises approximately the shape of a teepee, box and/or a cube, as shown in FIG. 5. It is understood that a wall of water may be formed as sheet, cone-shaped spray or other formation of water.

In some embodiments, the present disclosure further provides a safety device kit comprising: (i) at least one pipe configured to connect to at least one water source; (ii) at least two water suppliers, such as fog spray nozzles, configured to connect to the at least one pipe; (iii) at least one header configured to connect to the at least one pipe; and (iv) at least one valve configured to connect to the at least one header. In certain embodiments, the at least two water suppliers provided in the kit are configured to and/or configurable to spray sheets or walls of water that intersect one another. And in some embodiments, the kit is a retrofit kit for a drilling rig derrick. In some embodiments, the kit comprises a gate to retrofit to a railing in or on a derrick. And still further embodiments include a descending and/or escape device, wherein the descending and/or escape device is an escape device for use by a worker that will allow the worker to escape from a derrick.

The safety device and/or safety system of the present disclosure may further comprise a harness configured to be removably attached to a worker. In some embodiments, the harness is a wearable harness. That is, in certain embodiments, a worker can wear the harness and/or be otherwise physically attached and/or removably connected and/or removably attached to the harness. And in some embodiments, the safety device and/or safety system comprises a cable that is configured to connect and/or removably attach the harness to a mechanical device, such as a winch, that is capable of providing a pulling force sufficient to move and/or transport a worker. Furthermore, in some embodiments, the mechanical device system of the present disclosure comprises a winch, a harness and a cable, wherein the harness may be removably attached to the worker, the cable may be removably attached to the harness, and/or the cable may be connected and/or removably attached to the winch. Moreover, in some embodiments, the winch may be located within the water shed. And in certain embodiments, the winch is attached and/or removably connected to at least one side of the frame.

Moreover, in some embodiments, the winch, or other similar mechanical device or system, may be automated. Indeed, the winch may automatically move, transport and/or pull a worker toward itself upon activation. In some embodiments, the methods of the present disclosure include a step of transporting and/or moving a worker into an area inside the safety device, inside a housing defined by the safety device, within a frame defined by the safety device and/or into the water shed provided by water emitted from the safety device. In some embodiments, the derrick comprises the housing. In other embodiments, the derrick platform comprises the housing.

Certain embodiments of the safety device and/or safety system of the present disclosure further comprise at least one lighting component, such as a light and/or a light fixture. The light of the present disclosure may be activated in order to direct a worker to the safety device and/or particularly to the water shed.

Accordingly, in certain embodiments, the safety device and/or safety system of the present disclosure provides a person with additional time to escape from an explosion site, such as through a drop gate and a zip line. Still further details and embodiments of the invention(s) of the present disclosure are provided herein below.

One embodiment of the present disclosure comprises a safety device for a derrick, wherein the safety device comprises one or more water suppliers, such as positioned fog spray nozzles. In some embodiments, each of the water suppliers is or may be configured to spray a mist, sheet and/or wall of water in a particular direction so that the respective sprays intersect.

Further, the safety device may comprise a housing comprising a frame, wherein the frame has at least a first side and a second side. In some embodiments, one or more nozzles is connected to at least one pipe, at least one of the first side and the second side of the frame.

Moreover, in some embodiments, when the water suppliers are operated together, the water that they emit forms a water shed comprised of water from the one or more water suppliers. For instance, in certain embodiments, a water shed of the present disclosure comprises a wall of water that is comprised of water from the one or more water suppliers. And in certain embodiments, the water shed forms a shield against heat, smoke, fire and chemicals.

Figure 2A:
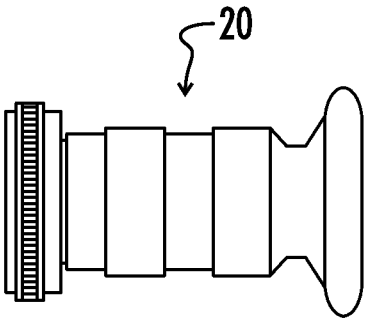
FIG. 2A, FIG. 2B, FIG. 2C and FIG. 2D each provide a view of a fog nozzle according to the present disclosure.
Figure 2B:
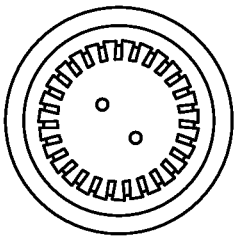
Figure 2C:
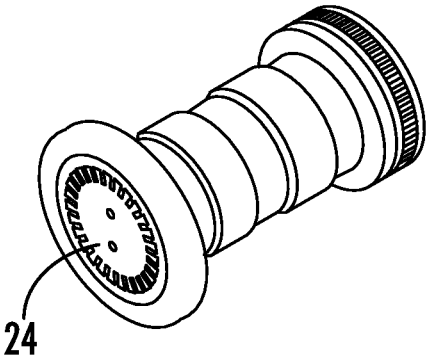
Figure 2D:
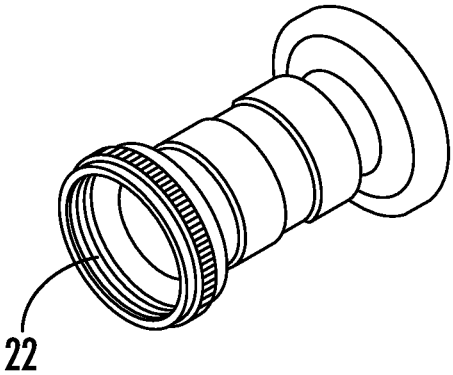

The device and/or system of the present disclosure can have additional water suppliers configured to spray in various directions depending on the type of fire or explosion risk. As shown in FIG. 2A, FIG. 2B, FIG. 2C and/or FIG. 2D, the water suppliers, such as fog spray nozzles, can be any commercially available water suppliers, but are, in any event, non-corrosive and heat resistant. Additionally, in some embodiments, the water suppliers and/or fog spray nozzles of the present disclosure can be those used by firefighters or similar to those used by firefighters, as known in the art. In some embodiments, a water supplier of the present disclosure is configured to provide a flow rate of between about 50 and about 2000 gallons per minute, between about 100 and about 1000 gallons per minute, between about 200 and about 900 gallons per minute, and/or between about 300 and about 800 gallons per minute at 100 psi. In certain embodiments, the water supplier is configured and/or adapted to provide a flow rate of about 200, about 300, about 400, about 500, about 600, about 700, about 800, about 900 and/or about 1000 gallons per minute at 100 psi. In a particular embodiment, the device comprises four fog nozzles, each of which delivers up to about 300 gallons of water per minute to the water shed. And in certain embodiments, the flow rate and/or spray pattern may be adjusted by manually manipulating the nozzle.

In one embodiment, flat stream style nozzles are used to create a wide, substantially flat stream of water. In another embodiment, wide-angle, cone-style nozzles and/or narrow-angle cone-style nozzles are used. Different styled and/or differently shaped nozzles change the shape of the water spray, but the particular shape of the water spray can be adapted to different applications in order to effectively provide water to a designated area, such as a water shelter. Accordingly, in some embodiments, the water supplier(s) of the present disclosure comprise low pressure nozzles and/or high-volume nozzles. Moreover, in certain embodiments, the water line(s) and/or pipe(s) of the present disclosure have a diameter of at least about 2 inches, which allows the water line(s) and/or pipe(s) to provide enough water to the water suppliers to create a water shed according to the present disclosure.

There are many industrial worksites where the risk of explosion and/or fire at a worksite is high. Each worksite presents a significant risk of harm to workers. In some applications, the work site can be in a building such as a building in a paper mill, power plant or refinery. In other applications, the worksite can be underground, such as a mine. In still other applications, the worksite can be outside, such as a welding site for repair of fuel tanks and/or for work on oil and/or natural gas pipeline(s). In certain embodiments, the risk of explosion may be at a particular storage location, such as a fertilizer storage facility or a natural gas storage facility. In each of these industrial worksites, workers may be killed while trying to escape either from suffocation by chemicals and fumes or by the heat of the explosion.

In one embodiment, the one or more water suppliers are attached to at least one pipe that is permanently installed and/or configured to operate in one location and/or designated area. This embodiment creates a particularly-calibrated water shed.

In an embodiment, the device of the present disclosure is suitable for use on a drilling rig derrick. In some embodiments, the water shed is designed to remain in a single location once installed. In other embodiments, at least one pipe is attached to a portable frame and/or the pipe itself forms a portable frame with a hose as a water source.

In some embodiments, the at least one pipe connects to a water source with a header connected to at least one water line and/or at least one pipe from a water source. In certain embodiments, the header carries the water and holds the nozzles and valve. The header can vary in size and shape, as suitable to the water pipe being used. The pipe and the header will be determined based on the work site, the water source, the water supplier(s), and the desired water flow.

On a drilling rig derrick, a pump (or pumps) pulls, pushes or draws water from a water tank or tanks. The pump can be a centrifuge pump and the tank can be any size. In certain embodiments, the centrifuge pump can be an ordinary, commercial centrifuge pump. In one embodiment, each pump and/or electric motor pump is about 3 inches wide and about 18 inches tall. And in some embodiments, the pump is a hydraulic pump. Moreover, in some embodiments, the pump is configured and/or adapted to move between about 100 and about 10000 gallons of liquid per minute. In some embodiments, the pump moves between about 1000 and about 9000, between about 2000 and about 8000, between about 3000 and about 7000 and/or between about 4000 and about 6000 gallons of liquid per minute. In a particular embodiment, the pump is capable of delivering up to about 9000 gallons, up to about 8000 gallons, up to about 7000 gallons, up to about 6000 gallons, up to about 5000 gallons, up to about 4000 gallons, up to about 3000 gallons, up to about 2000 gallons, up to about 1000 gallons, up to about 500 gallons, up to about 300 gallons, and/or up to about 100 gallons of liquid per minute to the safety device.

Further, in certain embodiments, the pump may be a pump that is already found on an oil rig, wherein the pump is useful in more than one application. For example, in one embodiment, the pump is a 4×3×10 American Petroleum Institute (API) Maxum Series—End Suction API610 Carver® pump, available from Carver Pump Company of Muscatine, Iowa USA. In other embodiments, the pump is provided as part of the presently-disclosed device and/or kit. Indeed, in certain embodiments, the device of the present disclosure comprises its own, dedicated pump. In at least one embodiment, the pump may comprise, for example, a 3×2×6 API Maxum Series—End Suction API610 Carver® pump, available from Carver Pump Company of Muscatine, Iowa USA. In other embodiments, the device is adapted to utilize an existing pump on an oil rig.

In some embodiments, a water source of the present disclosure comprises a water tank that can hold between about 1,000 and about 100,000 gallons of water. In a particular embodiment, a water tank of the present disclosure can hold about 60,000 gallons of water.

In one embodiment, the water source can be a container, such as a portable container, a municipal water source, a portable tank, a fracking tank, a fire service hookup or any other water source having sufficient pressure to operate the device.

The water source and/or water supply can be a circulating or a non-circulating loop water source. And in an embodiment, the water source remains pressurized with water so that when the device is activated, the flow of water is immediate and/or nearly so. Indeed, in some embodiments, the flow of water creates the water shed in less than 3 seconds, less than 2 seconds, and/or less than 1 second after the safety device is activated. In certain embodiments, all pipes between the tank and the water source remain pressurized with water.

In some embodiments, the water source and/or water supply can be an existing water tank that is on an oil rig. Such a tank may, for example, be plumbed for use throughout the rig. In other embodiments the water source and/or water supply may be a portable tank. For example, in some embodiments, the water tank may be portable on a trailer. Additionally, in certain embodiments of the portable device, the device also comprises a pump and a generator that is dedicated to run the pump.

In one embodiment, the device operates using a bypass system. In certain embodiments, the bypass system comprises one or more of a two-way valve, a spring-actuated valve and/or a vented valve. And in an embodiment, the bypass system comprises at least one valve that is a two-way, spring-actuated, vented valve. In certain embodiments, the valve comprises a commercially available two position, normally open, spring return valve. The valve can be any diameter, but it will often be the diameter of ordinarily available commercial water valves.

In the absence of heat, the at least one valve of the present disclosure is in an actuated, bypass position, which prevents water from flowing through a header to the water supplier, such as a nozzle. When the valve moves to the non-actuated position, water may pass through the valve into a header. In some embodiments, the valve may be manually forced to the actuated (bypass) position upon installation, and triggered by one or more switches or buttons located at the derrick platform, the water source, in a driller's shack, near the blow out preventer, accumulator and/or ground control center.

In some embodiments, the valve has a port on its return side, and the valve port on the return side of the valve may be plugged with a temperature actuated commercial sprinkler head (not shown). The temperature actuated sprinkler head prevents a spring from shifting the valve to the flow position. Once a predetermined temperature is reached and/or exceeded, the sprinkler head, nozzle, and/or other water supplier activates, which in turn vents the pressure on the return side of the valve, thereby allowing the spring to force the valve to shift and water to flow through the header and out the sprinkler head or nozzle.

In one embodiment the valve is actuated automatically for additional safety and security. In some embodiments, the one or more valves of the present disclosure can be electrically and/or mechanically operated. If electrically operated, a valve is connected by wires to a control panel. In some embodiments, the control panel is located on a drilling rig. And in many embodiments, the valve is mechanically operated, such that it will trigger/operate even when there is no electricity or other power source available to the device.

In some embodiments, the water suppliers of the present disclosure can be set to and/or arranged in a desired pattern, and in at least one embodiment the pattern (configuration) of the water suppliers can be changed and/or configured as desired. In other words, in certain embodiments, the water suppliers are movable and/or configurable such that the water they emit may be directed at one or more sections of a designated area.

Further, in certain embodiments, the water provided and/or emitted by the one or more water suppliers of the present disclosure is shaped by the configuration of the water suppliers. And in some embodiments, a supply pipe provides water to the water suppliers such that the water suppliers can emit and/or spray the water in the designated area. In certain embodiments, the supply pipe comprises a 2.5 inch supply pipe.

In an embodiment, one or more supply pipes of the present disclosure may have at least one nipple attached thereto. Further, in some embodiments, at least one water supplier of the present disclosure is attached to at least one nipple of at least one pipe, such as a supply pipe. For example, in certain embodiments, a nipple can attach to a nozzle by screw threads. And in one embodiment, all the pipes, nipples, heads and nozzles are standard commercial fire sprinkler components, as known in the art.

In some embodiments, the valve does not automatically reset to a bypass position. In another embodiment, the valve will automatically reset once the temperature drops below a threshold temperature. And in another embodiment, the device is triggered by something other than temperature, such as pressure and/or oxygen levels.

Further, in certain embodiments, the system can only be manually reset to a "ready" position. And in one embodiment, an electronic control valve can reset the system to a "ready" position.

In one embodiment, at least two nozzles are positioned to spray at least two walls of water from different locations so that the walls of water intersect along a plane. In some embodiments, the at least two walls of water provide a water shed, wherein the water shed may comprise intersecting walls of water that can act as a shield between a worker and a fire, chemicals, explosion, heat or other dangerous condition.

Additionally, in another embodiment, additional water suppliers (e.g. nozzles) are positioned to spray additional walls of water from different locations so that each wall of water intersects each other wall of water along different planes. When the device is activated and water flows through the water suppliers, the device creates a shelter, box and/or shed surrounded on two or more sides by sheets of water. In one embodiment, the water shed comprises four walls, a floor and a ceiling formed by sheets of spraying water. And in some embodiments, the device comprises four nozzles, whereas in other embodiments, the device comprises six nozzles. In still further embodiments, the device comprises an appropriate number of nozzles, as necessary to create the water shed. Accordingly, in some embodiments, the device comprises 10, 9, 8, 7, 6, 5, 4, 3 and/or 2 nozzles. In some embodiments, the water shed comprises intersecting non-linear or cone-shaped walls that form an irregular shaped water shed.

In certain embodiments, the sheets of water also protect at least one water pipe in order to prevent damage to the device itself during a fire or other emergency condition.

And in certain embodiments, the device of the present disclosure is provided on a portable frame, wherein the water suppliers are configured to protect the frame as well as by providing water thereto.

In certain embodiments, the device of the present disclosure comprises a water shed. The water shed is useful, for example, to provide a worker with protection from a fire.

Moreover, use of the water shed may provide additional time to escape from and/or survive a chemical exposure, explosion, a fire or the like. Accordingly, in some embodiments, the device of the present disclosure is designed to carry out, conduct and/or otherwise utilize evaporative cooling.

Evaporative cooling exploits the difference between the specific heat capacity of dry air as compared to the heat capacity of water. Specific heat capacity is the amount of energy required to change the temperature of a substance by one 1° C. The specific heat capacity of dry air is approximately 0.24 calories/gram ° C. (this value varies with temperature and pressure, but we assume normal conditions for simplicity here). The specific heat of liquid water at 100° C. is 1 kcal/gram ° C. Essentially, it requires approximately four times as much energy to raise the temperature of water by one degree as it does air. Additionally, when water evaporates to a gas at 100° C., the latent heat of evaporation requires an additional 540 calories/gram. Body temperature is 37° C. Roughly speaking, this means that it requires approximately 64 calories of energy to raise the temperature of one gram of air from body temperature to 101° C. while it requires approximately 603 calories to raise the temperature of one gram of water from body temperature and evaporate it to 101° C. Although these calculations are very simplified for the sake of explanation, the device of the present disclosure uses the tremendous heat absorption of water, via evaporative cooling, to maintain a lower temperature inside the water shed than outside the water shed (or on the other side of the water shed—in the case of a two-wall water shed). By continuously spraying water, even as the water evaporates, more water replaces it to continue the evaporative effect.

In still further embodiments, the device of the present disclosure is also designed to direct smoke, ash and chemicals away from the area protected by the water shed by creating pressure differentials that redirect or pull the smoke, ash and chemicals the same direction as the moving sheets of water. As a result of the moving sheets of water (i.e., walls of the water shed), the smoke, ash, and chemicals are redirected to travel around the water shed rather than passing through the area protected behind the sheets of water (i.e., protected by the water shed). In the case of a two-walled (such as, for example, a two-coned) water shed, which may comprise a shield shape, smoke, ash and/or chemicals may be deflected out away from the water shed.

Additionally, when the device of the present disclosure comprises a six-walled water shed, such as a box, cube-shaped and/or irregular shaped water shed, on a drilling rig derrick, even if smoke, ash and chemicals completely engulf the derrick, they would not easily enter the interior of the water shed created by the device because the continuous walls of water sprayed by the water suppliers would create a barrier through which it is difficult for smoke, ash and chemicals to pass.

In summary, then, as dry air from the fire passes through and/or contacts the water shed, the water evaporates. Further, the water absorbs heat and maintains a temperature difference between the area protected by the water and the area affected by an explosion or fire. Simultaneously, the moving water of the water shed can redirect smoke, ash and/or chemicals around the protected area inside the water shed to prevent a worker from suffocating therein.

In these ways, the device allows a worker additional time to react and/or escape an explosion, fire and/or other emergency condition. In some embodiments, the water shed created by the device of the present disclosure can be sufficient to protect the worker until the explosion is contained.

In some embodiments, the device of the present disclosure comprises a system to assist a worker in getting into an area protected by the water shed. In one embodiment, the device may comprise one or more lights, such as directional lights, and/or other directional indicators to guide a worker into the area protected by the water shed. In one embodiment, a bright light and/or a flashing light located inside the water shed is used to direct a worker into the water shed. In certain embodiments, the safety device of the present disclosure comprises at least one light connected and/or removably attached to at least one side of the frame.

In one embodiment, a guidance system of the present disclosure is a mechanical system. The guidance system and/or any component part thereof may be connected to the frame. For example, in certain embodiments, the guidance system comprises a harness attached to a worker, with a cable attaching the harness to a winch located inside the area protected by the water shed. In one embodiment, the cable is attached in the center of the derrick. In one embodiment, the cable is attached to a portion of the water shed. And in certain embodiments, the cable is connected to the center of the water shed. Further, in some embodiments, the cable is connected to the winch. And in some embodiments, the winch is connected to at least one side of the frame.

Upon activation of the water shed, in certain embodiments, a mechanical device, such as a winch, can automatically transport a worker toward the protected/designated area within the water shed. In certain embodiments, the mechanical device is sufficiently powerful and/or suitable to transport a worker weighing up to about 400 pounds, up to about 300 pounds, and/or up to about 250 pounds into the protected/designated area of the water shed.

In one embodiment, the mechanical device, such as a winch, can move a worker from anywhere in a work area (e.g. a derrick) to the water shed in less than about ten seconds. In certain embodiments, the mechanical device of the present disclosure can transport a worker from anywhere in a work area to the water shed in less than about five seconds. And in still further embodiments, the mechanical device of the present disclosure can transport a worker from anywhere in a work area to the water shed in between about two and about five seconds.

In one embodiment, a winch moves a worker at a steady and/or brisk walking pace to allow the worker to maintain balance while moving to a designated area, such as within a water shed. In certain embodiments, the winch is attached to a harness. And in some embodiments, the winch is automatically stopped when the harness reaches the winch. Indeed, in certain embodiments, the systems and/or devices of the present disclosure comprise an automatic shut-off that is activated when the harness reaches a location at and/or substantially proximal to the winch. In one embodiment, a harness of the present disclosure has a quick-release mechanism, such as a carabineer and/or latching device, so that a worker can detach the harness from the winch once inside the water shed and/or designated area.

And in certain embodiments, the device of the present disclosure further comprises a guide rail that leads from at least one location in a work area to the water shed and/or to a designated area within the water shed. In some embodiments, one or more guidance systems, such as a guide rail, may be used in a system of the present disclosure with or without a winch. Meanwhile, in some embodiments of the present disclosure, no guidance system is used.

Figure 4:
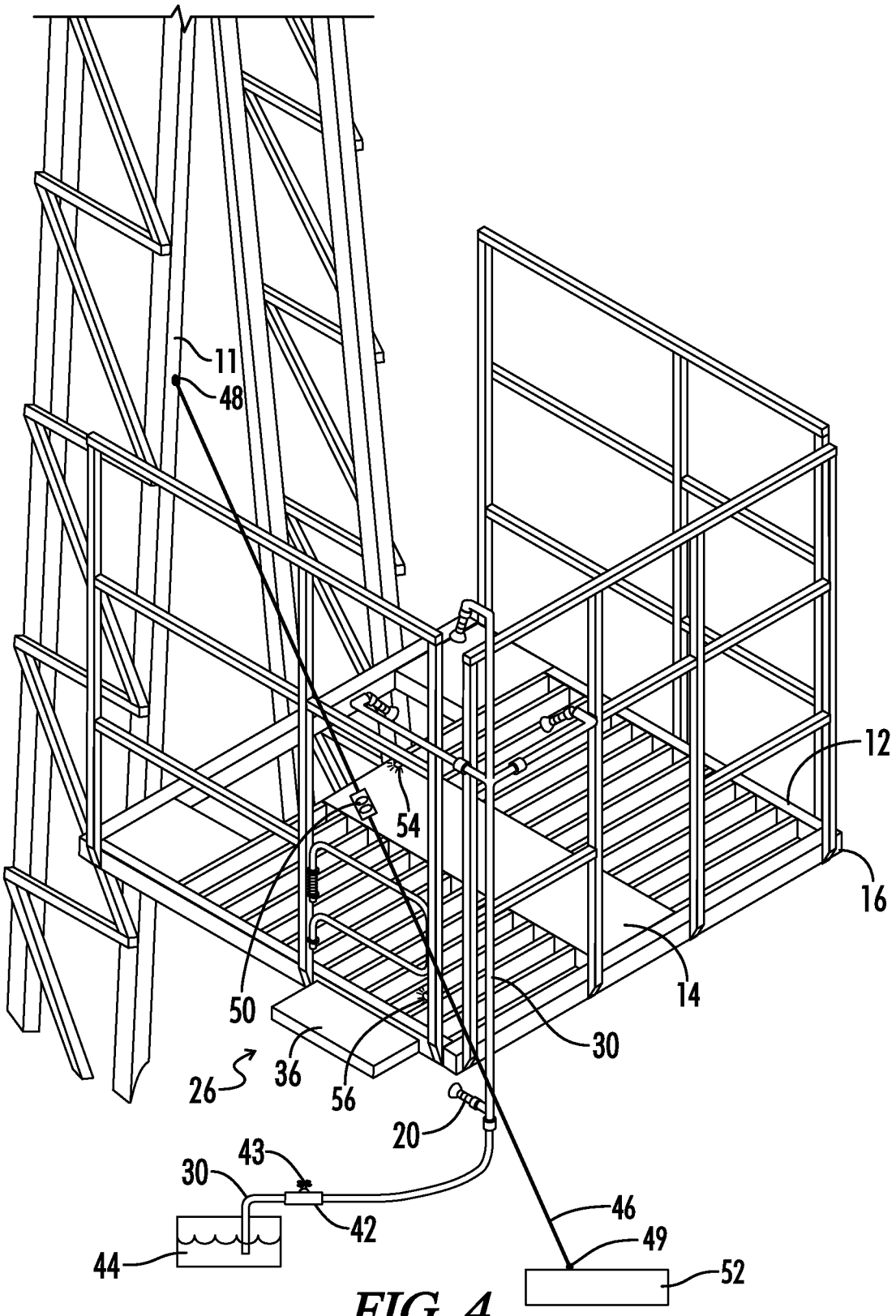
FIG. 4 is a perspective view of an embodiment of a safety device of the present disclosure.

Once a worker is located inside the water shed, the worker is able to compose himself and prepare to escape from the derrick. In one embodiment, as shown in FIG. 4, the present disclosure provides an escape device that comprises a descending device and/or an emergency gate on a derrick to facilitate a worker's escape from the derrick.

Figure 3:
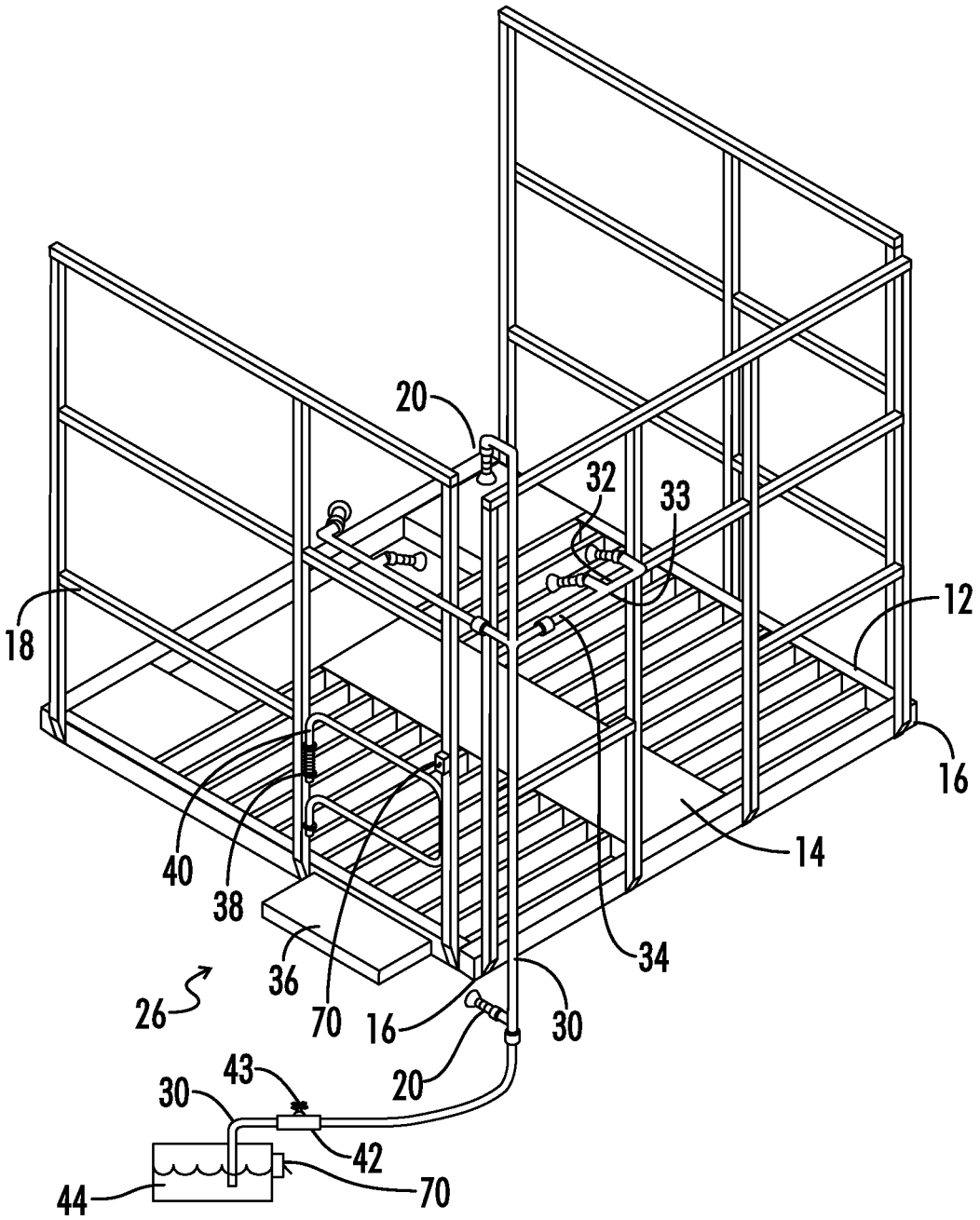
FIG. 3 is a perspective view of an embodiment of a safety device of the present disclosure.

In an embodiment, as shown in FIG. 3, the device further comprises a removable, swinging and/or drop gate through a derrick railing on one side of the water shed. In certain embodiments, the gate comprises the same material as the rest of the derrick railing. And in an embodiment, wherein the device is retrofitted to an existing derrick, the gate can be cut from the derrick railing and reattached as a gate.

In certain embodiments, a gate can be attached by hinges and/or other attachment means, as known in the art, and can move and/or swing out to the side of and/or below the derrick platform. In one embodiment, the hinges comprise pipe hinges attached along the bottom of the railing, connecting the railing to a derrick platform floor. In one embodiment, the gate is a slap rail or a hinge rail. In some embodiments, the gate is a spring-loaded gate that is attached to at least one handrail on the derrick. In certain embodiments, the gate has hinges that may be bolted and/or welded to the derrick and/or to any part thereof, such as a handrail.

In some embodiments, when the gate is opened, it provides an unobstructed exit from the derrick. And in one embodiment, the gate is a one-way hinged gate that opens inwardly so that a derrick hand cannot accidentally open it. In one embodiment, the gate is closed using a latch. In one embodiment, the gate can be activated automatically by a motor and/or a spring when the water shed activates. And in some embodiments, the gate can be manually opened by a lever or handle. In one embodiment with a latch, the latch can be activated automatically when the water shed activates or it can be manually opened. In an embodiment with a manual lever or handle, the lever or handle should be large enough and easily operable in limited visibility situations.

In one embodiment, the opened gate leads to an escape platform extending from the derrick. In certain embodiments, the escape platform is a self-folding platform. And in some embodiments, the escape platform is attached to the derrick and/or specifically to at least one of the derrick floor and the derrick rail(s) via hinges. Moreover, in an embodiment, the escape platform fold and/or unfolds with gravity, meaning that it is always in a down position when the rig is in use, but it can be moved into an "up" position manually. For example, when the rig is folded up, the escape platform can also be moved into the up position manually, or it may automatically move into the up position as a result of gravitational force(s).

In one embodiment, at least a portion of an escape device and/or escape system is provided in the water shed. In another embodiment, at least a portion of the escape device is provided external to the water shed.

And in some embodiments, a worker may attach himself to the escape device, open a gate and/or escape from the derrick. Further, the worker may reach at least a portion of the escape device while locate either within the water shed or on the escape platform. The escape device may comprise, in certain embodiments, a descending device, a zip line, and/or another type of commercially available mechanism that can lower a worker from an elevated work area (e.g. the derrick). In one embodiment, the escape device of the present disclosure is suitable to transport a worker weighing up to about 400 pounds, up to about 300 pounds, up to about 250 pounds and/or up to about 200 pounds from the derrick. And in some embodiments, the escape device comprises an automated device that is capable of transporting a worker from a work area at a first height/elevation to a ground area at a second height/elevation, wherein the first elevation is greater than the second elevation. In still further embodiments, the escape device is attached to at least one portion of the derrick. And in certain embodiments, the escape device comprises at least one cable, wherein a first portion of the cable is attached above the gate and a second portion of the cable is attached to at least one leg of the derrick. In certain embodiments, the escape device further comprises an anchor, wherein at least one portion of the cable is attached to the anchor. And in some embodiments, the escape device is located at a corner of the derrick board.

Further, in at least one embodiment, the escape device is a geared device. And in certain embodiments, the escape device is geared to control the speed of a worker's transport from the derrick. In certain embodiments, the escape device comprises a descending device, such as a Rescue Reel, as described in U.S. Pat. No. 8,499,890, which is hereby incorporated by reference in its entirety. In another embodiment, the escape device is a commercially available zip line device, such as an automated zip line device. In certain embodiments, an automated zip line device is configured to control the speed of a worker's descent down the line. Indeed, in one embodiment, the escape device is a trolley and/or a geared cable descent device.

In certain embodiments, the escape device comprises a rope and pulley system. And in some embodiments, the escape device and/or escape system allows a worker to descend safely from heights of less than about 500 feet, less than about 400 feet, less than about 300 feet, less than about 100 feet, less than about 90 feet, less than about 80 feet and/or less than about 50 feet. In still further embodiments, the escape device is attached to at least one point at ground level. For example, in certain embodiments, the escape device is attached to an anchoring component and/or anchoring device at ground level and also at the level of the work area. In some embodiments, the anchoring component comprises concrete and/or metal. And in a particular embodiment, the anchoring component is a concrete-filled receptacle or container, such as a concrete-filled barrel. Furthermore, in some embodiments, the anchoring component comprises a portion of a walking surface at the level of a work area. Moreover, the work area is provided at a higher elevation than a ground level in some embodiments.

As will be appreciated by a person having ordinary skill in the art, in some embodiments, the escape device of the present disclosure will not be used, and the water shed will be used alone. In some embodiments, the water shed and the guidance system will be used, but the escape device will be omitted. In other embodiments, other combinations of the water shed, guidance system and/or escape device will be used.

In some embodiments, water can be substituted with any other substance that is appropriate for fire rescue and/or fire safety and/or fire protection applications, as known in the art.

And in some embodiments, the derrick is retrofitted with a blast shield. In certain embodiments, the blast shield comprises a steel plate. The steel plate of the present disclosure may be, for example, a thick steel plate that is at least about 3 inches in at least one dimension. In some embodiments, the steel plate may be between about 3 and about 6 inches thick. And in certain embodiments, the steel plate may be located underneath an area of the derrick where the water shed is located.

Turning now to the drawings, FIG. 1 provides a perspective view of a derrick (10), having a first leg (11), a second leg (13), a third leg (15) and a fourth leg (17). The derrick is rectangular in shape, having a driller side (12), a non-driller side (19), a derrick side (21) and a non-derrick side (23) defining a derrick platform (14). The non-derrick side (23) of the platform (14) meets the non-driller side (19) of the platform at a first outer corner (16), and the non-derrick side (23) of the platform (14) meets driller side (12) of the platform (14) at a second outer corner (25). Furthermore, a handrail (18) surrounds the platform, forming a border, on at least one of the four sides (12, 19, 21 and 23). The handrail is raised from the platform (14).

Next, FIG. 2A, FIG. 2B, FIG. 2C and FIG. 2D each provide a view of a fog nozzle (20) according to the present disclosure. The fog nozzle (20) has a threaded end (22) that is adapted to connect with a pipe and a distribution end (24) that is adapted/configured to distribute a liquid. The nozzles (20) can be adjustable both in type of stream (i.e., cone-shaped or flat) to be sprayed and in direction of spray.

FIG. 3 provides a perspective view of an embodiment of a safety device (26) of the present disclosure. The safety device (26) includes a frame comprising a first pipe (30) and a second pipe (34). The frame has a first side (32) and a second side (33). Further, the safety device (26) includes an escape platform (36) that is attached to the non-driller side (19) of the derrick platform (14). Likewise, the embodiment provided in FIG. 3 includes a gate (40) that is movable on at least one gate hinge (38). Indeed, the gate (40) is movable on its hinge (38) to allow a derrick hand to leave the derrick platform (14) and move to the escape platform (36).

Additionally, FIG. 3 includes an illustration of the valve (42) that regulates the flow of water from a water source (44), through a pipe (30), wherein the valve (42) is attached to the pipe (30), and further wherein a header (43) is attached to the pipe (30).

As shown in FIG. 3, in one embodiment, two or more nozzles can be configured to spray walls of water that intersect with one another. Additionally, FIG. 3 includes an illustration of an embodiment equipped with one or more additional nozzles that are not configured to intersect with one or more of the sprays of water directed from the other nozzles. In such an embodiment, these additional nozzles are configured to spray an additional shield of water outside of and redundant to the water shed. In one such an embodiment, at least one nozzle is configured to spray a wall of water away from the area of the water shed and toward the center or derrick side (21) of the platform (14).

In one embodiment, as shown in FIG. 4, a nozzle (20) is configured to spray a wall approximately downward from above the height of a derrick hand on the derrick platform (14), a nozzle is configured to spray a wall underneath and about parallel to the derrick platform (14), and two nozzles are configured to spray walls to intersect the walls from the downward facing nozzle (one originating from the non-driller side (19) and one originating from the non-derrick side (23) of the platform (14). Each of these nozzles can be configured in different embodiments between about zero and ninety degrees from horizontal and between about zero and ninety degrees from vertical. In certain embodiments, the nozzles of the present disclosure can be configured upward or downward from the horizontal axis by about 0, about 10, about 20, about 30, about 40, about 50, about 60, about 70, about 80, and/or about 90 degrees. In certain embodiments, the nozzles of the present disclosure can simultaneously be configured away from the horizontal axis by about 0, about 10, about 20, about 30, about 40, about 50, about 60, about 70, about 80, and/or about 90 degrees. In certain embodiments, each nozzle can be configured to a different vertical and horizontal angle from the other nozzles.

FIG. 4 shows the safety device of the present disclosure including a cable (46), wherein at least a portion of the cable is attached at a first cable attachment point (48) to at least one leg (11, 13, 15, 17) of the derrick (10) and further wherein at least a portion of the cable (46) is attached at a second cable attachment point (49) to an anchor (52). In some embodiments, the anchor is provided on the ground and/or in a hole having an opening at ground level (not shown). A geared escape device (50) is provided on the cable (46) in proximity to the escape platform (36) such that a derrick hand can easily reach the geared escape device (50) when standing on the escape platform (36). Additionally, the device (26) shown in FIG. 3 includes a first safety light (54) provided on a first side (32) of the device frame and a second safety light (56) provided on a second side (33) of the device frame.

FIG. 4 provides a perspective view of an alternate embodiment of the safety device (26) of the present disclosure, wherein this embodiment has four nozzles (20).

Figure 7:
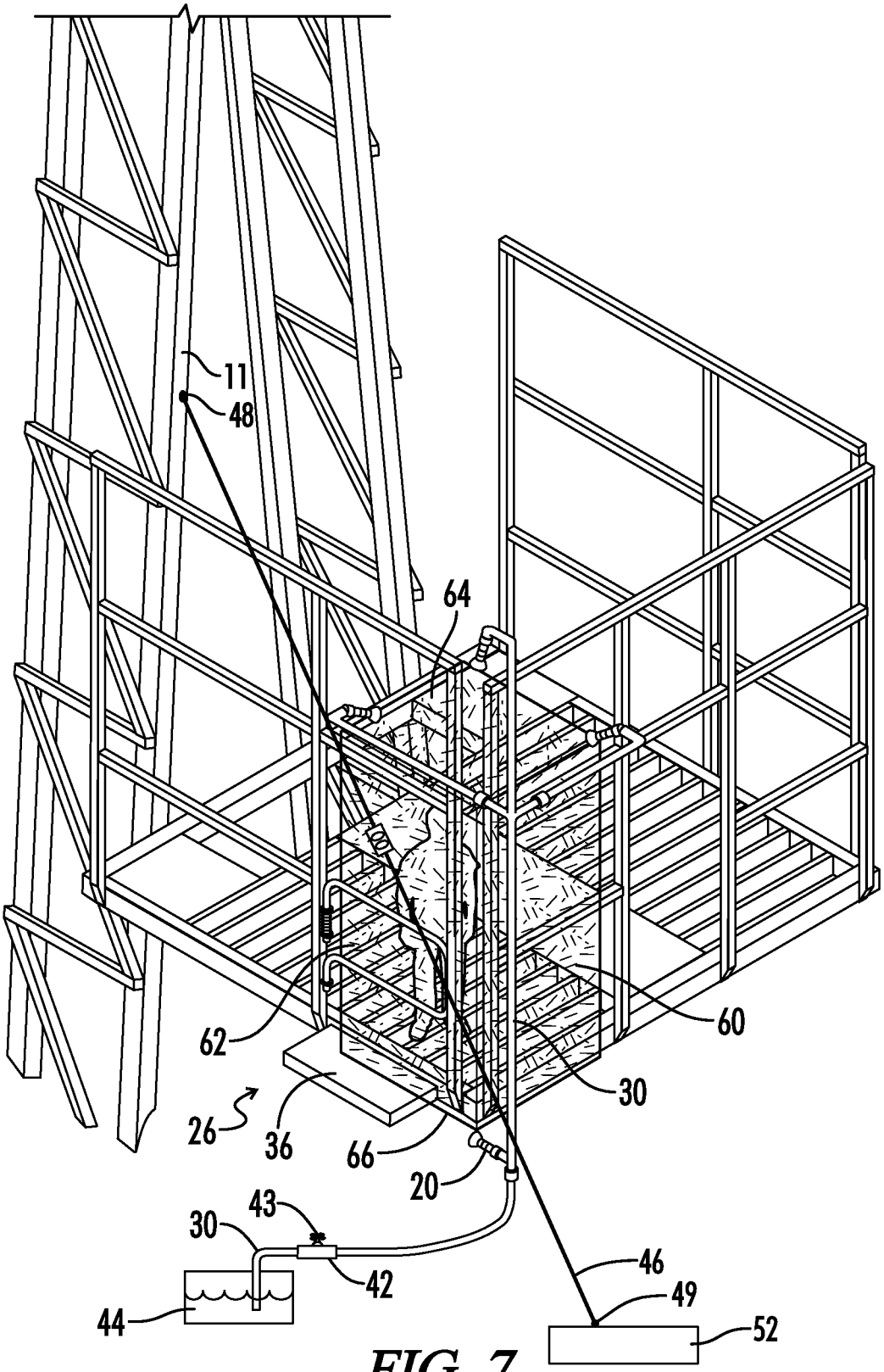
FIG. 7 is a perspective view of an embodiment of a safety device and water shed of the present disclosure.

Meanwhile, FIG. 5 provides a perspective view of an embodiment of a safety device (26) and water shed (70) of the present disclosure having two nozzles. Likewise, FIG. 6 illustrates a perspective view of an embodiment of a safety device and a water shed (70) of the present disclosure. In another embodiment, as shown in FIG. 7, the nozzles can be configured to spray flatter sheets of water, which form a water shed (70) that is approximately defined by a first plane (60), a second plane (62), a third plane (64) and a fourth plane (66). In an embodiment such as FIG. 7, the nozzles are configured to spray walls of water that intersect at about ninety degree angles respective to one another. In certain embodiments, some nozzles in an embodiment such as FIG. 7 can be configured to intersect one another at different angles, such as for example by about 0, about 10, about 20, about 30, about 40, about 50, about 60, about 70, about 80, about 90, about 100, about 110, about 120, about 130, about 140, about 150, about 160, about 170 and/or about 180 degrees.

Figure 8:
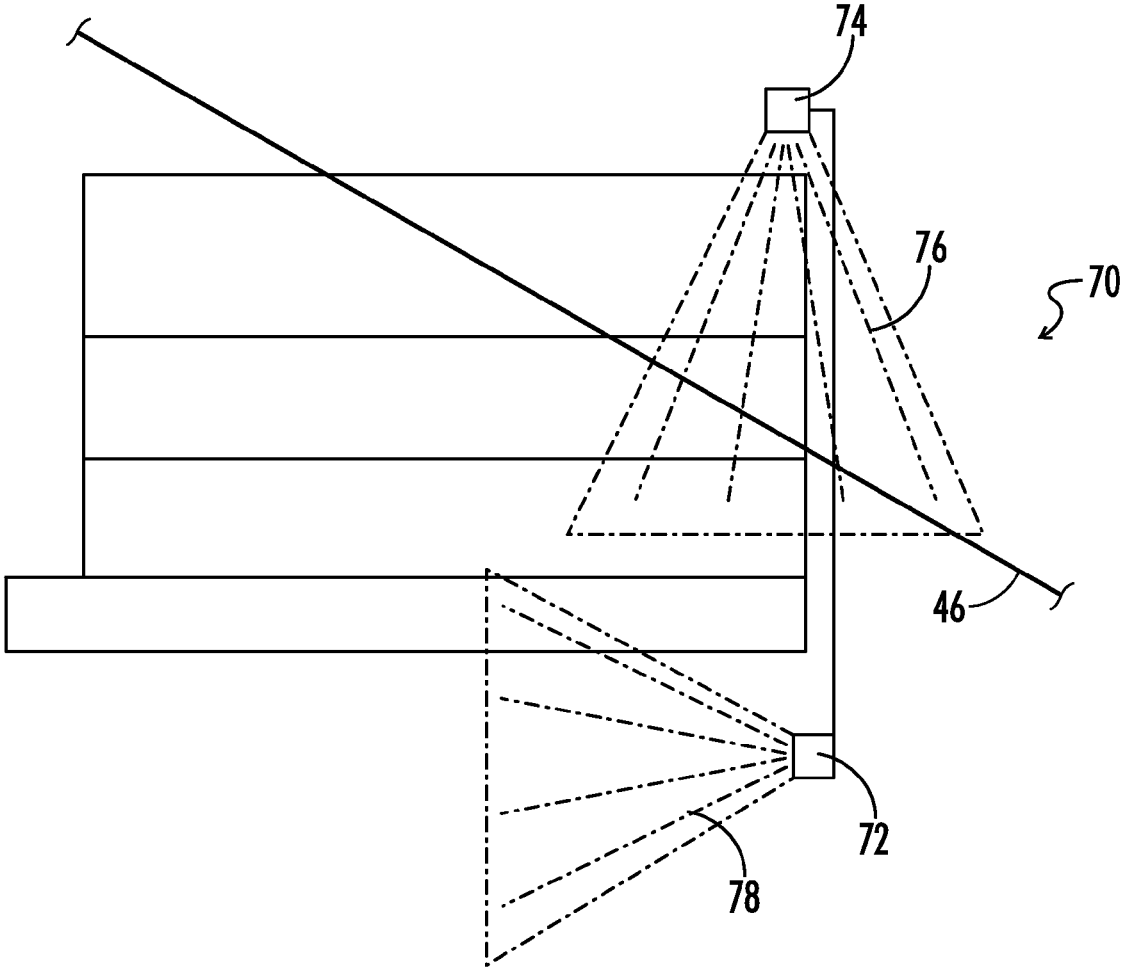
FIG. 8 is a cutaway view of a safety device and water shed of the present disclosure.

FIG. 8 is a cutaway view of a safety device and water shed of the present disclosure. FIG. 8 illustrates a water shed (70) comprising the first water spray (76) from a first nozzle (74) and the second water spray (78) from a second nozzle (72).

Figure 9:
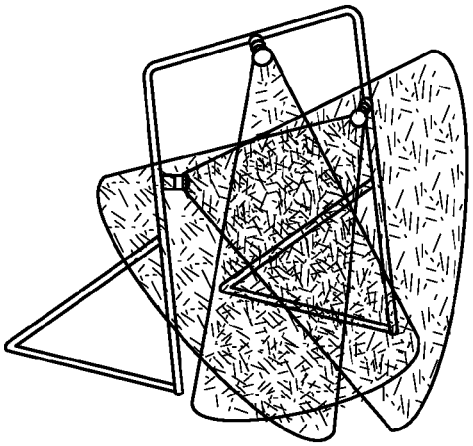
FIG. 9 is a perspective view of a portable safety device and water shed of the present disclosure.

Finally, FIG. 9 is a perspective view of a portable safety device and water shed comprising three nozzles attached to a portable frame, each nozzle spraying a different cone-shaped formation or wall of water. In the embodiment shown in FIG. 9, the water shed is formed at the intersection of the three formations or walls of water. In another embodiment at least two nozzles attached to a portable frame provide intersecting walls of water. In certain embodiments, the nozzles on a portable frame can be configured to spray water at different angles from the vertical axis of the frame itself, such as for example about 0, about 10, about 20, about 30, about 40, about 50, about 60, about 70, about 80, and/or about 90 degrees.

These and other features and/or advantages of the invention(s) of the present disclosure will be further understood and appreciated by those skilled in the art by reference to the specification, claims and appended drawings.

Preferred embodiments of the present disclosure are described herein. Variations of the preferred embodiments may become apparent to those having ordinary skill in the art upon reading the foregoing description. The inventors expect that skilled artisans will employ such variations as appropriate, and the inventors intend for the invention(s) of the present disclosure to be practiced other than as specifically described herein. Accordingly, this disclosure includes all modifications and equivalents of the subject matter recited in the claims appended hereto as permitted by applicable law. Moreover, any combination of the above-described elements in all possible variations hereof is encompassed by the present disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

One of ordinary skill in the art will recognize that additional embodiments or implementations are possible without departing from the teachings of the present disclosure or the scope of the claims which follow. This description, and particularly the specific details of the exemplary embodiments and implementations disclosed herein, is given primarily for clarity of understanding, and no unnecessary limitations are to be understood therefrom, for modifications will become obvious to those skilled in the art upon reading this disclosure and may be made without departing from the spirit or scope of the claimed invention(s).

What is claimed is:

1. A derrick safety device comprising:

a derrick;

at least one water source;

a housing comprising a frame attached to the structure of the derrick, wherein the frame has a first side and a second side;

at least one pipe connected to the water source;

at least two nozzles connected to the at least one pipe and to the first side of the frame, wherein the at least two nozzles are positioned to spray walls of water that intersect one another along one or more planes at a flow rate between about 50 and about 2000 gallons per minute to define a water shed area, said shed configured to encase and shield at least one person on the derrick from fire resulting from an oil rig explosion;

a header attached to the at least one pipe; and a valve attached to the header.

2. The derrick safety device of claim 1, further comprising at least two pipes, with at least one nozzle attached to each pipe.

3. The derrick safety device of claim 1, wherein at least one of the at least two nozzles is a fog spray nozzle.

4. The safety device of claim 1, wherein the water source is a municipal water source.

5. The safety device of claim 1, wherein the water source comprises a circulating loop water source.

6. The safety device of claim 5, further comprising a pressurized circulating loop water source.

7. The safety device of claim 1, wherein the valve is a two-way, spring actuated and vented valve.

8. The safety device of claim 7, wherein a spring in the valve opens the valve to allow water to flow through the header to the nozzles.

9. The safety device of claim 1, wherein the valve is a temperature-actuated valve.

10. The safety device of claim 1, wherein the intersection of the sheets of water is along a plane.

11. The safety device of claim 1, further comprising a winch connected to the first side of the frame.

12. The safety device of claim 1, wherein the safety device is attached to a drilling rig derrick.

13. The safety device of claim 1, further comprising at least one light source attached to the first side of the frame.

14. The safety device of claim 1, further comprising at least one light source attached to the second side of the frame.

15. A safety device kit comprising:

at least one pipe configured to connect to a water source; at least two fog spray nozzles configured to connect to the at least one pipe; a header configured to attach to the at least one pipe; and a valve configured to attach to the header;

wherein the at least two nozzles are configurable to spray walls of water that intersect one another along one or more planes at a flow rate between about 50 and about 2000 gallons per minute to define a water shed area, said shed configured to encase and shield at least one person from fire resulting from an explosion;

wherein the kit is a retrofit kit attached to the structure of a drilling rig derrick.

16. The kit of claim 15 further comprising a gate to retrofit a derrick railing.

17. The kit of claim 15, further comprising an escape device comprising a zip line.

18. The kit of claim 15, further comprising a winch.

19. The kit of claim 18, further comprising a harness.

20. The safety device of claim 1, wherein the at least two nozzles are flat stream nozzles.

* * * * *